United States Patent [19]

Hauser et al.

[11] 4,442,616

[45] Apr. 17, 1984

[54] IRONING TABLE WITH A MOVABLE BLOWER UNIT

[75] Inventors: Georg Hauser, Munich; Rolf Höggenstaller, Wessling, both of Fed. Rep. of Germany

[73] Assignee: J. Strobel & Sohne GmbH & Co., Munich, Fed. Rep. of Germany

[21] Appl. No.: 429,620

[22] Filed: Sep. 30, 1982

[30] Foreign Application Priority Data

Nov. 24, 1981 [DE] Fed. Rep. of Germany ..... 3146539

[51] Int. Cl.[3] ..... D06F 71/34; D06F 81/08

[52] U.S. Cl. ..... 38/14; 38/103

[58] Field of Search ..... 38/14, 103, 137

[56] References Cited

U.S. PATENT DOCUMENTS 4,259,796 4/1981 Riba et al. ..... 38/103 X
4,274,214 6/1981 Hauser .

FOREIGN PATENT DOCUMENTS 2456881 8/1976 Fed. Rep. of Germany ..... 38/103
2750817 7/1978 Fed. Rep. of Germany ..... 38/14

*Primary Examiner*—Werner H. Schroeder
*Assistant Examiner*—Andrew M. Falik
*Attorney, Agent, or Firm*—Bacon & Thomas

[57] ABSTRACT

An ironing table has a hollow table top (1) and a blower (11) arranged thereunder. The blower is connected to the table by a pivotable buffle (25), a helical housing (14), and a fixed orifice (12) located in a bottom section of said table. The top of the housing includes a suction orifice (12) and a pressure orifice (13). The blower and its housing are supported on rails (20) and may be displaced between two positions where the blower either applies a pressure or suction force to the surface of the table.

7 Claims, 3 Drawing Figures

IRONING TABLE WITH A MOVABLE BLOWER UNIT

The invention relates to an ironing table top and a blower arranged under the table top so as to selectively apply suction and blowing to the ironing surface.

Ironing tables of this type are known, as is shown in U.S. Pat. No. 4,274,214. Therein the opening in the bottom of the plate of the table is connected by means of a pipe connection with an intermediate chamber, to which the blower is fastened and into which both the suction orifice and the pressure orifice of the blower are opening. By means of baffles and connecting rods it is possible to connect either the suction orifice or the pressure orifice of the blower with the pipe connection, in order to apply suction or pressure to the upper ironing surface of the hollow table top.

High different configurations of such baffle mechanisms for the switching from suction to blowing operations and vice versa in the case of ironing tables have been proposed. In addition to the relatively complex and expensive configuration necessitated by them, considerable disadvantages occur in the case of these ironing tables particularly the relatively high power losses and the resultant high energy requirements of the blower and the relatively intensive noise, including the clatter of the baffles during switching.

It is the object of the invention specifically to eliminate the aforementioned disadvantages and to provide an ironing table which while using less energy for the blower, applies a stronger suction and blowing effect to the ironing surface, while the noise generation during operation is reduced to a minimum.

The ironing table according to the invention is characterized by very short flow paths and only a few flow reversals, both of which favor the generation of extraordinarily slight flow losses, so that it is possible to equip even ironing tables with large surfaces with one blower only, whereas heretofore they had to be provided with two blowers. The extensive elimination of flow reversals reduces the noise of the flow, while the absence of baffles reduces the generation of noise, because there no longer are impacts by the baffles during switching.

Hereinbelow a form of embodiment of the ironing table according to the invention shall be described with the aid of the drawing, as an example.

Figure 2:
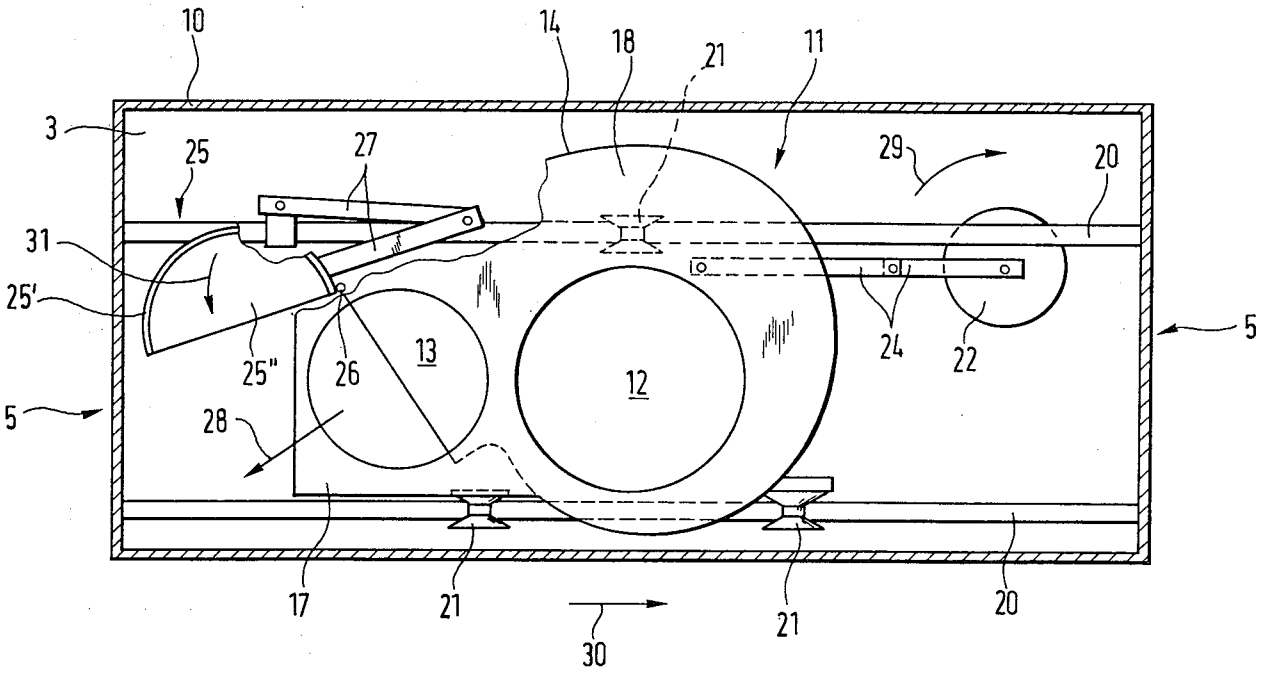
FIG. 2 is a view of the section along the line II—II in FIG. 1.
Figure 3:
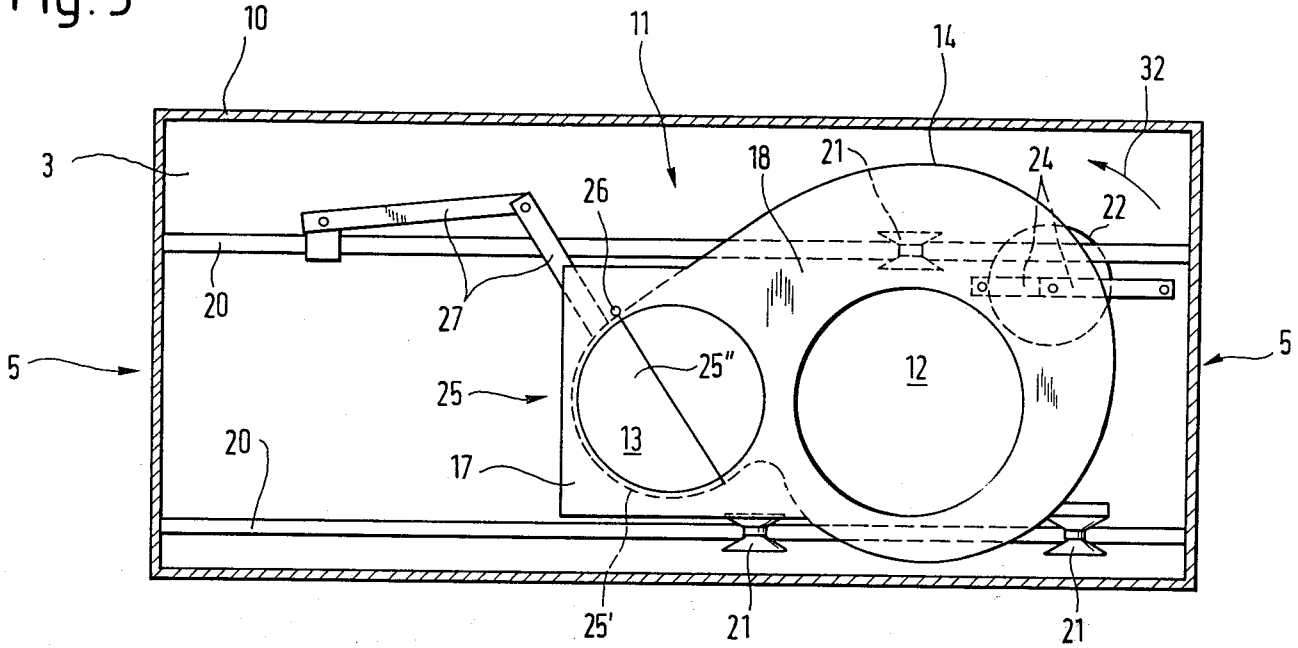

FIG. 3 the sectional view according to FIG. 2, with the ironing table in its state during the blowing operation.

The ironing table has a hollow table top 1 with an upper ironing surface 2 and a housing 3 with support legs 4 at the two narrow sides 5. The table top 1 is arranged on the housing 3 and fastened to it.

The ironing surface 2 of the table top 1 is permeable to gas and consists for example of a perforated metal sheet with a covering of a textile material. In its center, the bottom 6 of the hollow table top 1 has an orifice 8 surrounded by a ring 7, through which the inner space 9 of the table top 1 may be exposed selectively to suction and pressure, in order to suction off air and steam from the ironing surface 2 to the inside or to blow air under pressure to the outside.

Inside the housing 3, the rear wall of which consists of perforated sheet metal, a blower 11 with a suction orifice 12 and a pressure orifice 13 is arranged. The blower 11 is in the form of a radial blower with a helical housing 14 and has a drive motor 15 flanged onto the helical housing 14 for the radial rotor 16. The latter is arranged coaxially with respect to the suction orifice 12 provided in the upper wall 17 adjacent to the table top 1 of the helical housing 14, similarly to the pressure orifice 13 of the blower 11, to which the gradually widening pressure line 18 of the blower 11 is leading. The suction orifice 12 and the pressure orifice 13 of the blower 11 are thus located in the same plane that is approximately parallel to the table top 1.

Figure 1:
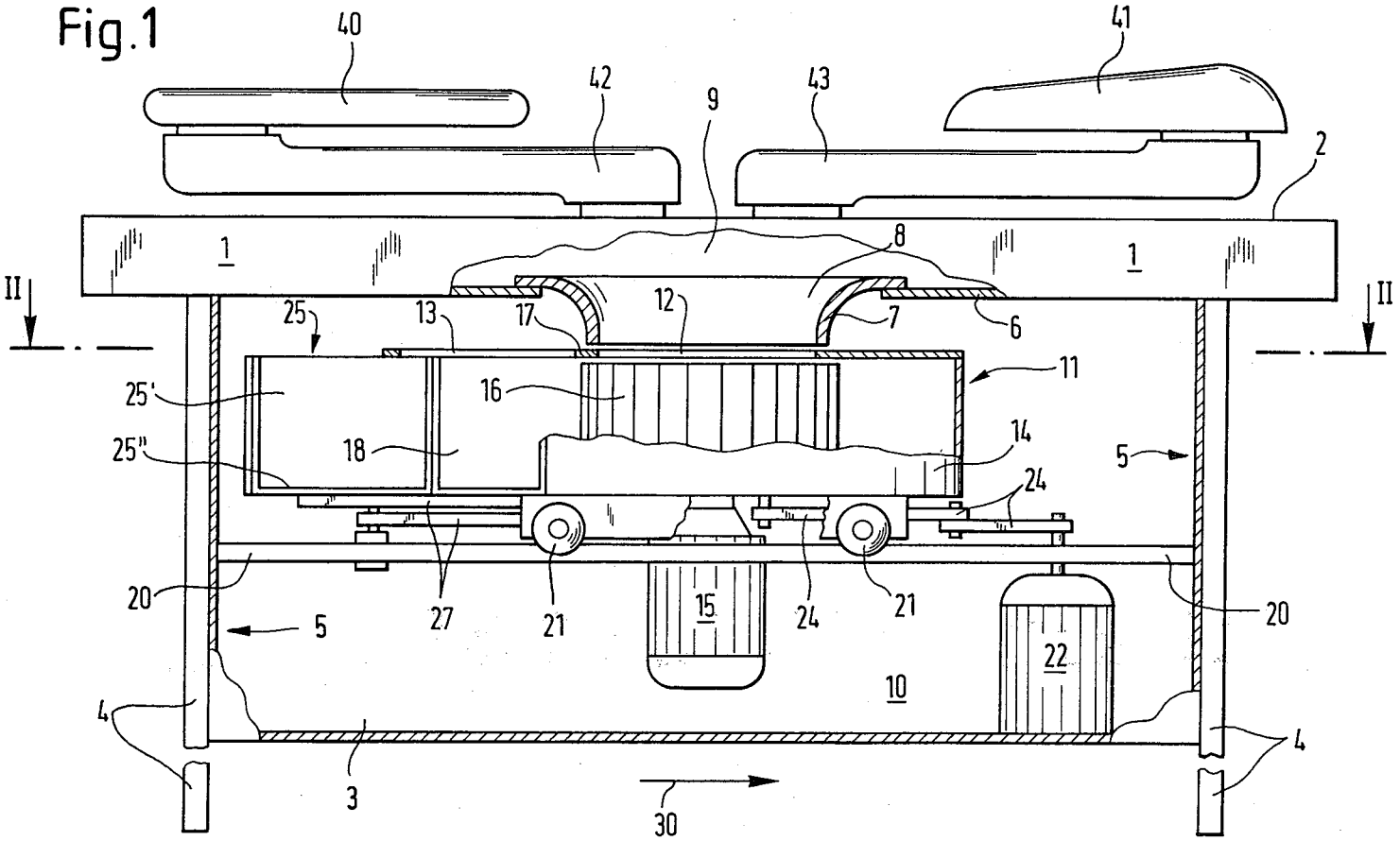
FIG. 1 shows a front elevation of an ironing table wherein the front wall of the housing is cut away under the table top and the ironing table is shown in its state during the suction operation.

The blower 11 may be moved between two positions wherein it is located with the suction orifice 12 or the pressure orifice 13 in front of the orifice 8 in the bottom 6 of the table top 1, as shown in FIGS. 1 and 2, and FIG. 3. In order to make possible this back and forth movement of the blower 11 along the plane of the suction orifice 12 and the pressure orifice 13, in the housing 3 a pair of rails 20 is provided parallel to said plane, extending between the two narrow sides 5 of the housing 3. The blower 11 is equipped on the bottom side of the helical housing 14 with three outer rolls 21 and may be displaced with them on the pair of rails 20. An electric servomotor 22 is used to move the blower 11 on the pair of rails 20; said servomotor being equipped with a built-in transmission, connected by means of connecting rods 24 with the helical housing 14 of the blower 11.

In order to reduce the outflow resistance of the blower 11 during suction at the ironing surface 2 according to FIGS. 1 and 2, the helical housing 14 of the blower 11 is equipped with a baffle 25 for the opening on the frontal side of the pressure line 18 of the blower 11 under the pressure line 13 in the position of the blower 11 which the latter occupies during the suction operation, as shown in FIGS. 1 and 2. The compressed air coming from the radial rotor 16 is then not diverted at approximate right angles toward the pressure orifice 13, but is able to exit without a change in the direction of flow from the pressure line 18 of the blower 11.

The baffle 25 has the approximate configuration of a roughly semicylindrical pot and is equipped with an approximately semicylindrical lateral wall 25' and a roughly semicircular bottom 25''. It is hingedly attached at one lateral edge around an axis perpendicular to the plane of the suction orifice 12 and the pressure orifice 13 of the blower 11, to the helical housing 14 and may be actuated by means of a linkage 27, acting on one side on the baffle 25 and on the other on the adjacent rail 20.

During the suction operation according to FIGS. 1 and 2, the blower 11, the radial rotor 16 whereof is being maintained in rotation by the actuated drive motor 15, is suctioning at the suction orifice 12, through the ring 7, air from the hollow table top 1. The reduced pressure produced in the inner space of said table top acts to suction off air and the water vapor possibly generated during ironing over the entire ironing surface to the inside. The baffle 25 is in its open position so that the flow of air produced by the radial rotor 16 is able to exit in the direction of the arrow 28 (FIG. 2) without deflection from the pressure line 18 of the blower 11.

If the blowing or pressure operation is to be actuated, the servomotor 22 with the configuration of a drive motor, is activated to move the linkage 24 in the direction of the arrow 29 (FIG. 2). This results in the fact that the blower 11 is displaced from its position according to FIGS. 1 and 2 in the direction of the arrow 30 into its position according to FIG. 3, in which the pressure orifice 13 of the blower 11 is located in front of the ring 7 and the orifice 8 surrounded by said ring. During this movement of the blower 11 on the pair of rails 20, the baffle 25 is pivoted by the action of the linkage 27 around the axis 26 in the direction of the arrow 31 (FIG. 2) into the closed position according to FIG. 3, so that the flow of air produced by the radial rotor 16 may exit only through the pressure orifice 13 from the pressure line 18 of the blower 11, in order to enter through the orifice 8 in the bottom 6 of the table top 1 into the internal space 9 of said table top and to generate an overpressure therein, so that air is being blown to the outside over the entire ironing surface 2.

The switching of the ironing table from the blowing operation to the suction operation is effected in a similar manner, by that the servomotor 22 is again actuated, in order to displace through the linkage 24 the blower 11 from its position according to FIG. 3 into that of FIGS. 1 and 2, against the direction of the arrow 30 (FIGS. 1 and 2), while the baffle 25 opens and the linkage 24 is displaced in the direction of the arrow 32 (FIG. 3) by the gear of the servomotor 22. During each movement of the blower 11 from the position according to FIGS. 1 and 2 into that of FIG. 3 or vice versa, the arm of the linkage 24 connected with the servomotor 22 and its gear, respectively, is pivoting by approximately 180° in the direction of the arrow 29 and 32, respectively. In the housing 3 two limit switches may be provided, which in cooperation with the moving blower 11 deactivate the servomotor 22 at the completion of the movement of the blower 11 in the direction of the arrow 30 and in the reverse direction, when the pressure orifice 13 or the suction orifice 12 of the blower 11, is aligned with the orifice 8 surrounded by the ring 7 in the bottom 6 of the hollow table top 1.

The movement of the blower 11 between the two abovedescribed positions according to FIGS. 1 and 2 or 3, is not necessarily effected by motor drive, but may be performed directly by the operating personnel. For this purpose, the ironing table may be equipped in place of the servomotor 22 with gear and the linkage 24 for example on its frontal side with an operating rail extending in the longitudinal direction, which is connected through a suitable linkage with the blower 11 and its helical housing 14.

It is further possible to equip the ironing table with additional ironing hoods 40 and 41, which are inserted replaceably and rotatingly in the free end of a pivoting arm 42 and 43, with the said pivoting arms 42 and 43 being bearingly and rotatingly supported at the other end of the hollow table top 1 and equipped with a device closing off the hollow pivoting arms 42 and 43 from the internal space 9 of the hollow table top 1, when the pivoting arm 42 or 43, respectively, is in the rest position according to FIG. 1, while it places the hollow pivoting arms 42 or 43, respectively, in communication with the internal space 9 of the hollow table top 1, so that suction or blowing may be applied to the ironing surface of the associated ironing hood 40 or 41, when the pivoting arm 42 or 43 is moved by the operating personnel from its rest position into its operating position toward the frontal side of the ironing table.

The displaceable blower 11 renders it possible to accurately set the reduced or excess pressure in the internal space 9 of the hollow table top 1 and thus the intensity of the suction or blast applied to the ironing surface 2 by the suitable selection of the overlap of the suction orifice 12 or the pressure orifice 13 of the housing 11 on the one hand and the orifice 8 in the bottom 6 of the hollow table 1, on the other. In the relative positions of the orifices according to FIGS. 1 and 2 and FIG. 3, maximum suction or pressure intensity is obtained by the complete mutual alignment; this intensity may be reduced by the appropriate displacement of the blower 11 on the rail pair 20, thereby reducing the mutual overlap of the suction orifice 12 or the pressure orifice 13 and the orifice 8, to any value desired.

We claim:

1. An ironing table provided with a hollow table and a blower arranged under the table, said blower being connected to the table for the selective application applying suction and blowing air to an ironing surface of the table through an orifice in a bottom section of said table, characterized in that the blower may be displaced between a first position and a second position, in said first position said blower applies suction to said ironing surface through said orifice in said bottom section and in said second position said blower blows air to said ironing surface through said orifice in said bottom section.

2. An ironing table according to claim 1, characterized in that a suction orifice is provided at said first position a pressure orifice is provided at said second position of the blower, said suction orifice and said pressure orifice are located in the same plane substantially parallel to the table and the blower may be moved back and forth along said plane.

3. An ironing table according to claim 2, characterized in that the blower has a configuration as a radial blower with a helical housing, the helical housing is provided with a baffle which controls the opening of a pressure line of the blower, the baffle is located adjacent the pressure orifice and the suction orifice is located in front of the orifice in the bottom section of the table.

4. An ironing table according to claim 3, characterized in that the baffle is pivotingly mounted around an axis perpendicular to the suction and pressure orifices and is adapted to be actuated by means of a linkage provided between the baffle and a housing which contains the blower.

5. An ironing table according to claim 2, characterized in that the blower may be displaced by means of rolls on a pair of rails substantially parallel to the plane of the suction and pressure orifices.

6. An ironing table according to claim 5, characterized in that the blower may be displaced by means of a servomotor.

7. An ironing table according to claim 5, characterized in that the blower may be displaced by means of an operating rail provided on a side of the ironing table and through a linkage.

* * * * *